United States Patent [19]

Capron

[11] Patent Number: 4,801,221

[45] Date of Patent: Jan. 31, 1989

[54] OCEANWHEEL BREAKWATER

[76] Inventor: Mark E. Capron, 3129 Lassen St., Oxnard, Calif. 93033

[21] Appl. No.: 51,977

[22] Filed: May 19, 1987

[51] Int. Cl.[4] ..... E02B 3/04

[52] U.S. Cl. ..... 405/34; 405/21; 405/30

[58] Field of Search ..... 405/15, 16, 21, 28, 405/30–35, 272, 284, 285, 286, 287

[56] References Cited

U.S. PATENT DOCUMENTS

| | | | |
|---|---|---|---|
| 231,957 | 9/1880 | Dyer | 405/33 X |
| 827,279 | 7/1906 | Winter | 405/30 |
| 978,897 | 12/1910 | Kelley | 405/27 |
| 1,166,580 | 1/1916 | Davies | 405/34 |
| 1,575,362 | 3/1926 | Haupt | 405/34 |
| 1,880,838 | 10/1932 | Curney | 405/32 |
| 1,969,123 | 8/1934 | Doble | 405/32 X |
| 2,341,515 | 2/1944 | Rehfeld | 405/32 |

FOREIGN PATENT DOCUMENTS

| | | | |
|---|---|---|---|
| 607890 | 4/1926 | France | 405/30 |
| 47372 | 7/1909 | Switzerland | 405/30 |
| 2029876 | 3/1980 | United Kingdom | 405/31 |

*Primary Examiner*—Dennis L. Taylor

*Attorney, Agent, or Firm*—Michael J. McGowan; Arthur A. McGill; Prithvi C. Lall

[57] ABSTRACT

A compression wall and tension spoke structural system which transfers lateral loads from the sea surface to the sea floor efficiently. The cellular breakwater combines tension piles and concrete fabric forms with oceanwheel structural elements to form cells which are serially placed in tangential contact to produce a breakwater of desired shape and length in shallow water.

6 Claims, 4 Drawing Sheets

OCEANWHEEL BREAKWATER

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION (1) Field of the Invention

The present invention relates to breakwaters and more particularly to an ocean breakwater structure comprising a plurality of attached cells, each deriving their load resisting support from an oceanwheel element incorporated as the supporting structure thereof.

(2) Description of the Prior Art

It is well known that breakwaters have been constructed for many years by using a mound of rubble fill of sufficient height. Steel sheet pile breakwaters have also been constructed using interlocking sheet piles which are driven into the sea floor and are then filled with earth and stone to provide support in resisting wave loads impinging from the ocean side of the breakwater. Further, steel sheet piles have been used to form closed geometric cells. These cells have also been arranged in series and filled with earth or gravel to form a breakwater of desired length, shape and structural integrity. A breakwater of the latter type resists wave forces by means of the compression strength, shear strength and mass of the fill used. Such cellular breakwaters, however, require a long installation time period due to the need to drive the sheet piles, the need to remove any sub sea floor obstruction encountered, and the cost and time associated with filling each cell. What is needed is a transportable, rapidly erectable, cellular breakwater which does not require fill for its wave load resisting strength.

SUMMARY OF THE INVENTION

Accordingly, it is a general purpose and object of the present invention to provide a cellular ocean breakwater which does not require fill. It is a further object that such a cellular breakwater be easily and rapidly transported and erected. Another object is that the load resisting elements of such cells be structural wheel elements (oceanwheels) employing compression rims and tension spokes. Still another object is that such breakwater cells be capable of extracting energy from impinging waves and producing electric power therefrom.

These objects are accomplished with the present invention by providing a compression wall and tension spoke structural system which transfers lateral loads from the sea surface to the sea floor efficiently. The cellular breakwater combines tension piles and concrete fabric forms with a plurality of oceanwheel structural element cells in serial tangential contact to make a breakwater in shallow water.

BRIEF DESCRIPTION OF THE DRAWINGS

A more complete understanding of the invention and many of the attendant advantages thereto will be readily appreciated as the same becomes better understood by reference to the following detailed description when considered in conjunction with the accompanying drawings wherein.

DESCRIPTION OF THE PREFERRED EMBODIMENT

Figure 1:
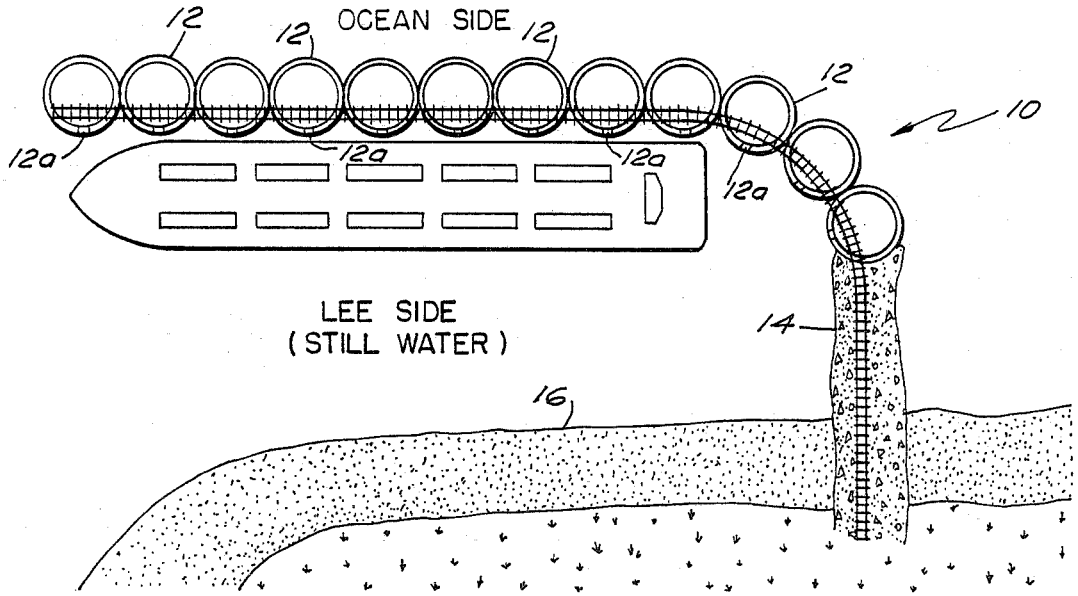
FIG. 1 shows a plan view of a cellular oceanwheel breakwater according to the present invention.

Referring now to FIG. 1 there is shown an oceanwheel breakwater 10 comprising a serial arrangement of independent cells 12, preferably circular, in tangential contact with at least one other cell. The cells do not contain fill and have been left partly open, shown schematically at 12*a*, on the lee side to ensure that overtopping will not raise the water level inside the cells significantly above the still water level. A short section of well known rubble mound type breakwater 14 is shown connecting breakwater 10 to shore 16. It is well known that a vertical wall, plane-faced, breakwater founded in water deep enough will completely reflect incident waves. The forces on such a prior art plane-faced wall have been taught by many, including Wiegel, R. L., "Wave Forces", *Oceanographical Engineering,* Prentice Hall, Inc., 1964, pp. 248–296. Cells 12 of breakwater 10 are structurally based on the teachings of the oceanwheel structural element set forth in my U.S. Pat. No. 4,606,674 and incorporated by reference herein. Since the plurality of oceanwheel cells of breakwater 10 present a multi-arched surface vice a plane-faced wall to impinging waves, Wiegel's model represents only a crude approximation of the actual forces on breakwater 10. For example, "Clapotis formation" will probably be lower around the curves of cell 12 and higher in the valleys where adjacent cells 12 meet.

Figure 2:
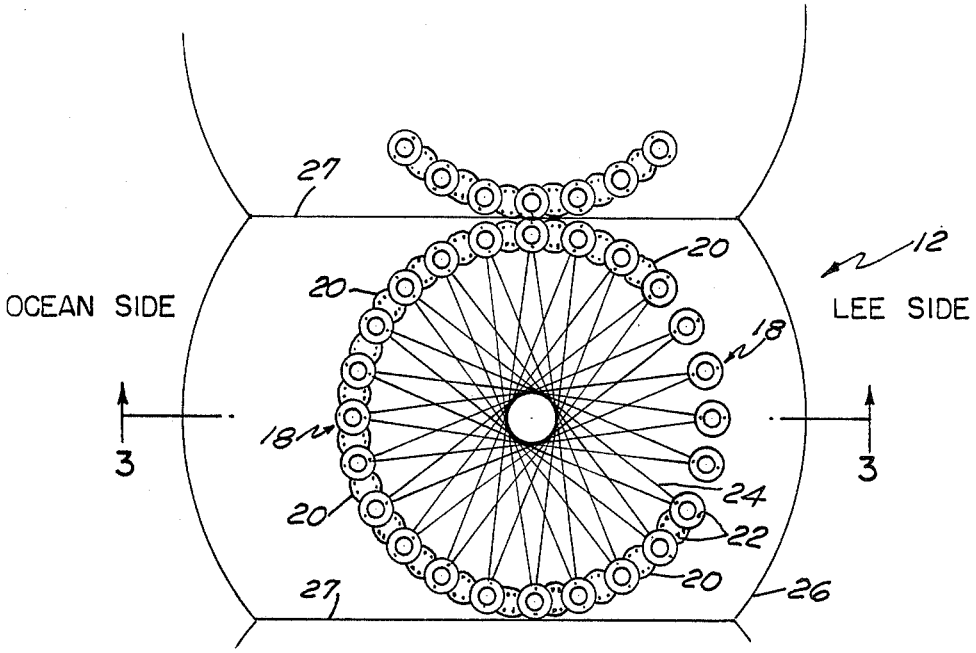
FIG. 2 shows a typical detail plan view of a breakwater cell of FIG. 1.
Figure 4:
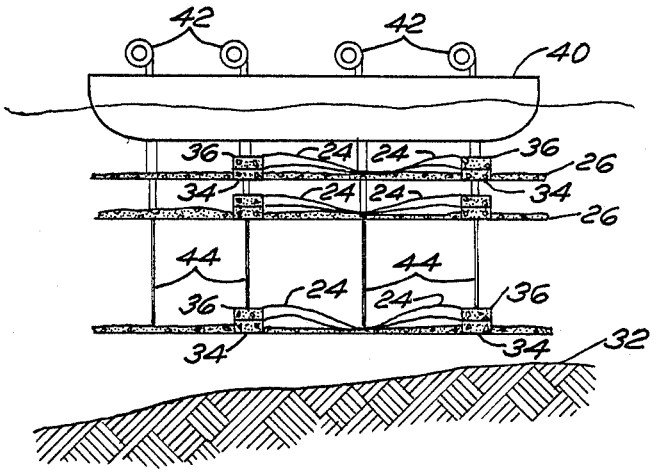
FIG. 4 shows an erection scheme for construction of a cellular oceanwheel breakwater.
Figure 5:
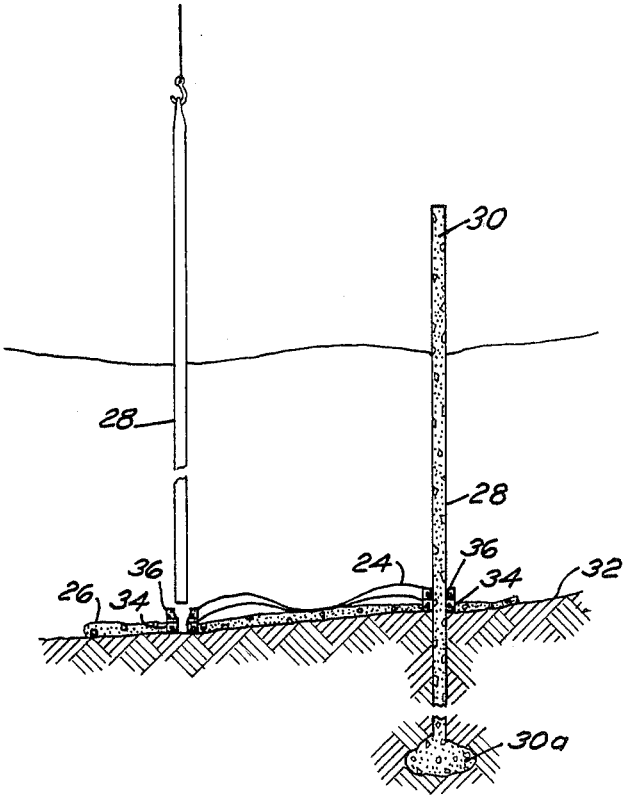
FIG. 5 shows a further step in the construction method of FIG. 4.

FIG. 2 shows a plan view of a typical breakwater cell 12 taken just below the top rim more fully described herein. Cell 12 further comprises a plurality of cylindrical support posts 18 uniformly spaced a preselected distance apart around the circumference of cell 12. Posts 18 have uniform diameters selected to produce, in conjunction with the cell rim circumferences, gaps therebetween. A corresponding plurality of reinforced concrete vertical members 20 are then formed in the gaps between posts 18, these members having a shape substantially as shown in FIG. 2. This shape acts to lock members 20 between adjacent posts 18 thereby forming the wall of a cell 12. The concrete matrices of posts 18 and members 20 each are reinforced by a plurality of vertical steel rebars 22 which are cross braced by spiral wrapping or using other well known bracing methods not shown. In addition, posts 18 are selectively cross connected at the top and bottom by a plurality of tension spokes 24 arranged using a tangential spoking pattern as more fully described in my U.S. Pat. No. 4,606,674. A scour protection mat 26 of concrete and wire mesh attaches to the outside and inside diameters of the bottom rim and rests on the ocean floor inside and outside cell 12 reaching further to the ocean side to prevent erosion due to wave action. Asphalt may be used in lieu of concrete. A partial section of an adjacent cell 12 is shown in typical tangential contact with the cell 12 described above while the adjacent scour protection mats 26 are truncated along mating cords 27 to accommodate such juxtaposition.

Figure 3:
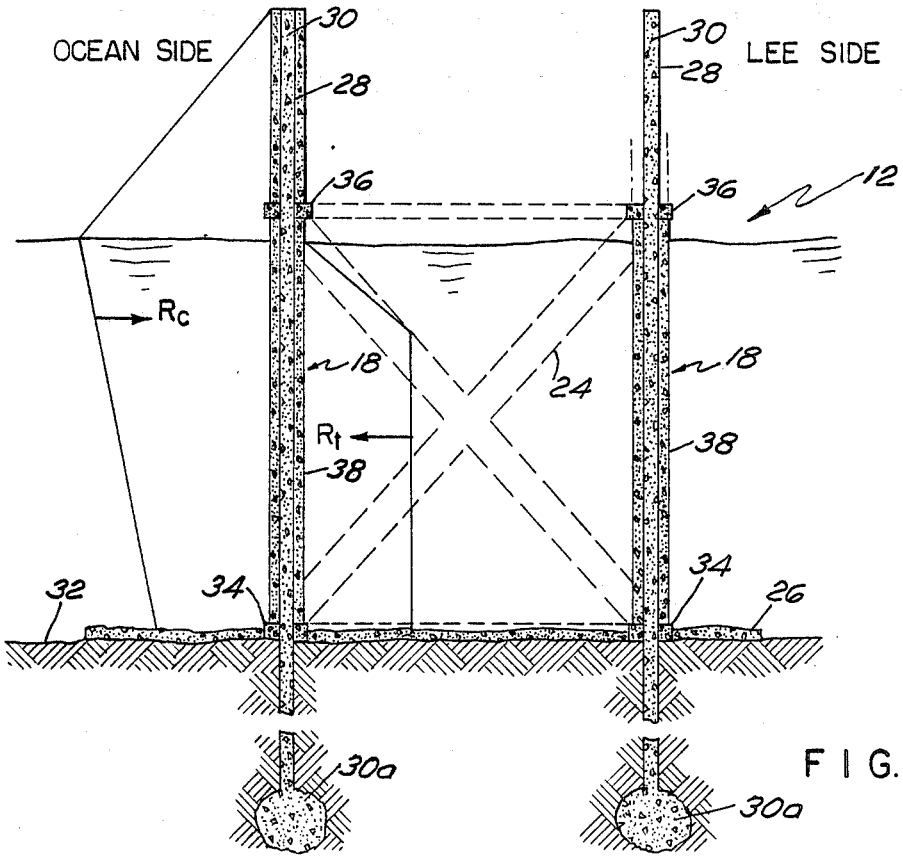
FIG. 3 shows a cross section of the breakwater cell of FIG. 2 taken along line 3—3 thereof.

FIG. 3 shows a cross-sectional view of the cell of FIG. 2 taken along line 3—3 thereof. A typical support post 18 further comprises a hollow steel pipe pile 28 filled with concrete 30. Pipe 28 is first driven into sea floor 32 to serve as a support pile and then concrete 30 is injected into the pipe under pressure thereby forming an enlarged concrete mass 30 beneath sea floor 32. Bottom compression rim 34 and top compression rim 36 are arranged co-axially and each rim has cast therein a like number of circular apertures which freely pass pipes 28. The rims are then held in separation by reinforced concrete columns 38 which are formed in place while rims 34 and 36 are subject to a separating force. The separating force also acts to place spokes 24 in tension which in turn keeps concrete columns 38 in compression.

Rims 34 and 36 are necessary to transfer internal reactions when spokes 24 are pre-tensioned, which preferably occurs before the multi-segment walls are formed. Although cast monolithically, both rims are semiflexible and permit movement out-of-plane. Bottom rim 34 thus conforms to the seafloor although there may be some local damage. The area around each pile acts as a joint. The bottom rim shape is reflected in top rim 36 after spoke pretensioning. This damage and out-of-plane motion can be tolerated because the unbraced length is relatively short and further, the wall also acts as a rim once cured. The wave crest force, Rc, forces the wall sections facing the ocean to act as an arch. Most of the load is transferred to the rims by the combination of arch compression and shear. The wave trough force, Rt, is resisted by the wall sections in beam action spanning between the top rim and bottom rim. The wave force diagram of FIG. 3 represents an average of the force normal to the cell wall. The wall is thus comprised of vertical fabric-formed concrete columns 18 and 20 with column 20 shaped as shown in FIG. 3. The fabric forms are left in place and the columns would act independent of each other were it not for the arch effect and the shape of member 20.

Spokes 24 are of steel wire rope and have lengths selected to accommodate the depth of water where the cell is placed. Spoke terminations are pre-formed and spliced around templates which fit over the piles at the rims. The wire rope is flexible for ease of transportation and installation. Excellent corrosion protection is obtained by covering the rope with a hose. After the spokes are tensioned, the hoses are pumped full of grout.

Scour may occur from water percolating underneath the cell wall, not just from currents or wave action in front of the wall. It is possible for the piles to support the cell in spite of such scour and resultant wave transmission. However, it is generally more economical to place scour protection both outside and inside each cell. Eckert, J. W., "Design of Toe Protection for Coastal Structures", *Proceedings of the Conference Coastal Structures* '83, ASCE, pp. 331–341, recommends designing scour protection for such geotechnical and hydraulic considerations. By prefabricating the scour protection as a flexible concrete or asphalt mat, it can be produced and installed together with the rims and spokes as one base unit.

Global overturning is resisted by both structure weight and tension in the piles. Pipe piles permit formation of a concrete ball in order to substantially increase their tensioning capacity. The concrete adds mass and improves the bending strength of the pipes.

FIGS. 4, 5, 6 and 7 describe the fabrication method of a typical breakwater cell. Scour mats 26, top and bottom rims 34 and 36, and spokes 24 are prefabricated and arranged in a dry dock as a single base unit. Bottom rim 34 is incorporated into the flexible scour protection. Spokes 24 are spliced around templates which are cast into both rims. The spokes are arranged so that if the rims are pulled apart, the structure of FIG. 3 is formed. Several cell base units are cast one on top of the other. When complete, the dry dock is flooded. A barge 40 lifts the whole stack of cell base units for transport and placing as in FIG. 4 using winches 42 and cables 44.

A crane (not shown) on rails atop a completed cell, stabs pipe piles 28 through rims 34 and 36 and spoke terminations in the base units. Driven piles are filled with concrete 30. Working from a solid platform such as rubble mound or an assembled cell 12, with the base unit as a guide at the sea floor, this effort is relatively insensitive to wave action.

Figure 6:
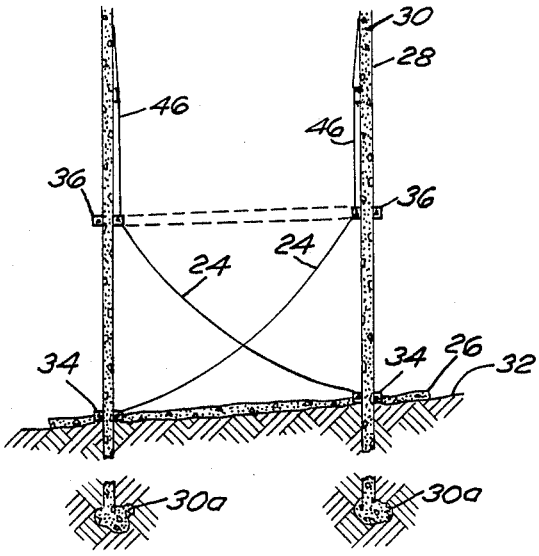
FIG. 6 shows a further step in the construction method of FIG. 4.
Figure 7:
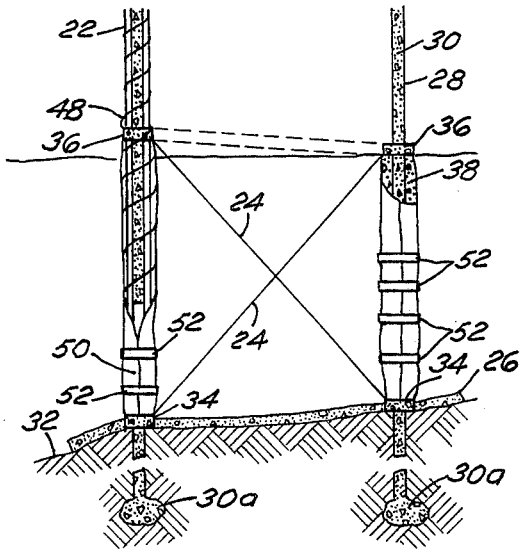
FIG. 7 shows a further step in the construction method of FIG. 4.

Bottom rim 34 is epoxy grouted, clamped or welded to piles 28. This prevents rim 34 from slipping upward when spokes 24 are pretensioned. Top rim 36 is lifted with cable pullers 46 as shown in FIG. 6. Final tensioning is done with commercially available hydraulic jacks (not shown). The pile and spoke unit is at this point a rigid assembly capable of holding the piles and concrete forms steady during cure. FIG. 7 shows additional reinforcing steel rebar 22 placed through top rim 36. Spiral lateral reinforcement 48 is coiled around vertical bars 22. Fabric concrete forms 50 are zipped up around each combination of 22, 48 and pile 28. Lamberton, B. A., "Fabric Forming for Underwater Concrete", *Proceedings of the Conference Coastal Structures* '83, ASCE, pp. 619–645, indicates that this size and height of fabric form will exceed current fabric strengths and suggests steel bands such as 52 on the lower half of the form to contain the hydrostatic pressure of the concrete. The forms are sealed to the piles at bottom rim 34 and filled with concrete 38. After the pile sections cure, between pile sections are braced in place and filled with concrete to form columns 20.

A rebar cage of vertical rebar 22 and cross members together with fabric forms are used to form the wall sections between the piles and must be held steady while the concrete sets. Thus, the rebar cage acts as a skeleton for the fabric bag. It may be designed to brace against the cured pile section concrete 38 or free stand. The complete rebar skeleton and bag assembly are built ahead of time for easy deployment.

An oceanwheel cell 12 operates quite differently from the prior art pile cell. The cylindrical arch wall transmits loads to the rims. The rims are braced by the spokes. A breakwater made with a series of such cells resist wave forces by means of the tensile strength of the spokes. Both a simple truss and a rigid rim displacement structural analysis are set forth in my U.S. Pat. No. 4,606,674 and in Capron, M. E., "The OCEANWHEEL Artificial Island," *Proceedings of the Conference Arctic* '85, American Society of Civil Engineers (ASCE), pp. 57–65, respectively. For quick estimates of spoke tension, assume the lateral load on top rim 36 from one direction is shared equally by one fourth of the spokes.

Figure 8A:
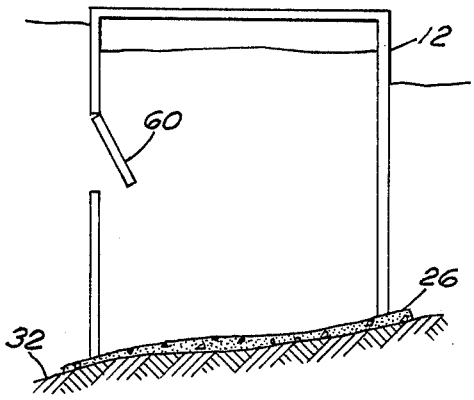
FIG. 8A shows a typical oceanwheel cell having an inwardly operating check valve.
Figure 8B:
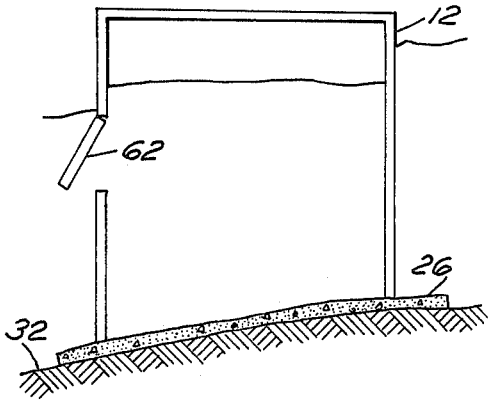
FIG. 8B shows a typical oceanwheel cell having an outwardly operating check valve.
Figure 9:
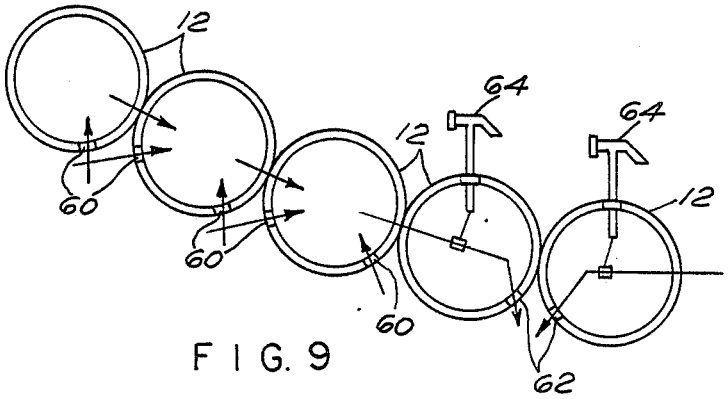
FIG. 9 shows an energy conversion process using adjacent check valved cells in conjunction with water hammer pumps.
Figure 10:
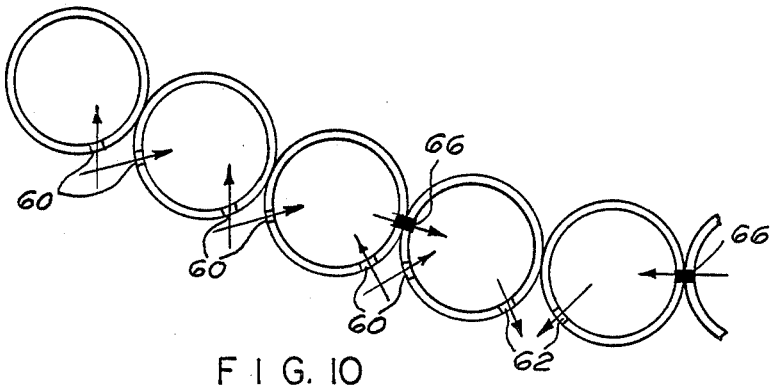
FIG. 10 shows an energy conversion process using adjacent check valved cells with high flow turbines.

FIGS. 8–10 describe a wave energy conversion process using an open cell breakwater such as the oceanwheel breakwater 10. Some of the cells 12 such as FIG. 8A only let water in, mostly at wave crests. Some of the cells 12, such as FIG. 8B, only let water out, mostly at wave troughs. This is accomplished by incorporating checkvalves 60 and 62 respectively in the seaward walls. There are no leeward openings for this application. The water flows from high water cells of FIG. 8A to low water cells of FIG. 8B and this flow is tapped by low head turbines to generate electricity. FIG. 9 shows schematically water hammer type pumps 64 well known in the art. They convert the high flow, low pressure water to low flow, high pressure water. This higher pressure water may then be pumped up to an elevated tank and energy recovered with high pressure turbines which are smaller and cheaper than low pressure, high flow turbines. Alternately, FIG. 10 shows a more direct energy conversion approach with a low pressure high flow turbine 66 placed between high and low water cells 12. The water in and out check valves 60 and 62 are placed near the arched cell intersections to improve efficiency because that is where the wave energy is focused.

Under certain conditions, oceanwheel cells as described herein can be economically substituted for sheet pile cells. Breakwater 10 represents such a case. Specific advantages for the oceanwheel cell breakwater 10 include: a resulting breakwater that is suitable for deep water or soft foundation soils because it transfers lateral load efficiently; there is little chance of a chain reaction progressive failure, because the cells act independently; during construction, a partially completed cell can survive a storm; the breakwater can be built upon an uneven seafloor; and the breakwater lends itself to wave energy production.

The oceanwheel breakwater cell is an improvement over steel sheet pile cells. It offers the flexibility of not requiring fill and may thus be used where the soil or local materials will not easily support massive structures. The breakwater uses both mass and pile tension to resist any overturning and sliding.

What has thus been described is a compression wall and tension spoke structural system which transfers lateral loads from the sea surface to the sea floor efficiently. The cellular breakwater combines tension piles and concrete fabric forms with oceanwheel structural elements to produce a plurality of cells that are serially arranged to make a breakwater in shallow water.

Obviously many modifications and variations of the present invention may become apparent in light of the above teachings. For example: The diameter and number of pile posts, the diameter and number of cells, and the shape and length of the breakwater can be varied to suit load conditions.

In light of the above, it is therefore understood that within the scope of the appended claims, the invention may be practiced otherwise than as specifically described.

What is claimed is:

1. A breakwater, extending a preselected length along the seafloor from a shoreline into an ocean, said breakwater having a height sufficient to protrude above the high tide level of said ocean, and having a shape with respect to said shoreline so as to present one side thereof toward incoming ocean waves, for producing a generally sheltered body of water on the leeward side thereof, said breakwater comprising:

shore connecting means, extending orthogonally outward a preselected distance from said shoreline, for providing access to water of a desired depth between said seafloor and said ocean level; and oceanwheel cell means, further comprising a first oceanwheel cell, an end oceanwheel cell and one or more intermediate oceanwheel cells, said cells being arranged serially on said seafloor such that said first cell being abutted to said shore connecting means, said intermediate cells being positioned in tangential contact with each of two adjacent cells and said end cell being in tangential contact only with the intermediate cell furthest from said shore connecting means, each said first, end and intermediate cell having an individual preselected height chosen to accommodate variations in depth from said seafloor to said ocean level and further to protrude above said high tide water level, for forming thereby said breakwater of preselected length and shape having said leeward side and said ocean side.

2. A breakwater according to claim 1 wherein said shore connecting means further comprises a mound of rubble fill of varying depth such that the top surface thereof remains at said preselected height above said ocean high tide level.

3. A breakwater according to claim 2 wherein each of said plurality of oceanwheel cells further comprise:

a top circular compression rim of precast concrete having a first axis perpendicular to the plane of said top rim and a plurality of first circular apertures passing therethrough and uniformly spaced around the periphery thereof;

a plurality of tension member spokes, said spokes having a length selected to accommodate the water depth where said cell is placed, one end of each said spoke being fixedly attached to said top rim and arranged tangentially, one at each first aperture thereabout;

a bottom circular compression rim having a second axis perpendicular to the plane of said bottom rim, said rim resting on the seafloor, and spaced a preselected distance from and coaxial with said top rim, said bottom rim being fixedly attached to the opposite ends of said tension spokes, said bottom rim having a corresponding plurality of uniformly spaced second circular apertures aligned with said first circular apertures and passing therethrough, said spokes attaching to said bottom rim at each said second aperture location;

a plurality of circular pipe pile means, uniformly spaced around the periphery of, and slidably attached through, said first top rim apertures, said pile means passing through and being fixedly attached to said second bottom rim apertures in such a way as to place said spokes in tension and thereby place said top and bottom rims in compression, said pile means further extending through said bottom rim apertures a preselected distance into said seafloor, said pipe pile means having cast concrete rebar reinforced posts of a preselected uniform diameter formed thereabout such that adjacent pile means have gaps less than said uniform post diameters remaining therebetween, said posts being in contact with said top and bottom rims to maintain said spoke tension;

a plurality of interstitial rebar reinforced concrete members, said members being formed in said gaps between said plurality of pile means and, as formed, being in contact with said top rim, said bottom rim and with each adjacent pile means, said members thereby forming, in conjunction with said pile means, a circular cell wall having a multi-arched face; and scour protection means, attached to said bottom rim inside and outside diameters, for covering an area of said sea floor greater than said cell in order to prevent erosion from wave action and percolation.

4. A breakwater according to claim 3 wherein said interstitial members on the leeward side of said cell means are not in contact with said top rim thereby allowing any seawater from wave overtopping to seek the level of the calmer lee side water.

5. A breakwater according to claim 3 further comprising:

a first plurality of inflow checkvalves, fixedly attached to the outer wall of a first preselected plurality of cell means near the junction with adjacent cell means and positioned at a height above the mean wave level, for permitting capture, by said first cell means, of water from said impinging waves;

a second plurality of outflow checkvalves, fixedly attached to the outer wall of a second preselected plurality of cell means near the junction with adjacent cell means and positioned at a height below the mean wave level, for permitting draining of said captured water at wave troughs; and waterhammer pump means, fixedly attached to said second cell means, for receiving said captured water and converting the potential energy thereof into kinetic energy.

6. A breakwater according to claim 3 further comprising:

a first plurality of inflow checkvalves, fixedly attached to the outer wall of a first preselected plurality of cell means near the junction with adjacent cell means and positioned at a height above the mean wave level, for permitting capture, by said first cell means, of water from said impinging waves;

a second plurality of outflow checkvalves, fixedly attached to the outer wall of a second preselected plurality of cell means near the junction with adjacent cell means and positioned at a height below the mean wave level, for permitting draining of said captured water at wave troughs; and low-head turbine means, fixedly attached between said first and said second cell means, for receiving said captured water and converting the potential energy thereof into electric energy.

* * * * *